US005342272A

United States Patent [19]

Pittroff

[11] Patent Number: 5,342,272

[45] Date of Patent: Aug. 30, 1994

[54] LOAD DISTRIBUTION DEVICE FOR WEIGHT LIFTING

[76] Inventor: Mark D. Pittroff, 4081 Creek Rd., Cincinnati, Ohio 45241

[21] Appl. No.: 8,647

[22] Filed: Jan. 25, 1993

[51] Int. Cl.[5] ..... A63B 21/065

[52] U.S. Cl. ..... 482/106; 224/265

[58] Field of Search ..... 482/104, 105, 106; 224/201, 265, 266; D21/196, 197

[56] References Cited

U.S. PATENT DOCUMENTS

| | | | |
|---|---|---|---|
| 2,653,401 | 9/1953 | Sutherland . | |
| 2,760,699 | 8/1956 | Rivers-MacPherson | 224/265 |
| 2,794,277 | 6/1957 | Dryden . | |
| 3,035,747 | 5/1962 | Ullrich, Jr. | 224/265 |
| 3,679,107 | 7/1972 | Perrine . | |
| 3,785,337 | 1/1974 | Flowerday . | |
| 3,949,708 | 4/1976 | Meeks . | |
| 4,213,605 | 7/1980 | McPeak . | |
| 4,353,225 | 10/1982 | Rogers . | |
| 4,425,874 | 1/1984 | Child . | |
| 4,428,327 | 1/1984 | Steckel . | |
| 4,612,877 | 9/1986 | Hayes et al. . | |
| 4,694,781 | 9/1987 | Howe et al. . | |
| 4,722,524 | 2/1988 | Waszkelewicz . | |
| 4,774,503 | 9/1988 | Bussard . | |

FOREIGN PATENT DOCUMENTS

| | | | |
|---|---|---|---|
| 1484353 | 6/1989 | U.S.S.R. | 482/106 |

OTHER PUBLICATIONS

Advertisement in *Strength and Health,* Dec. 1971, p. 128 for Sonata International.

Advertisement in Ironman Magazine, "Super Squat", Feb. 1971, p. 60.

*Primary Examiner*—Richard J. Apley
*Assistant Examiner*—Jeanne M. Mollo
*Attorney, Agent, or Firm*—Steven J. Rosen

[57] ABSTRACT

A weight lifting device is provided which removably snaps to the bar of a barbell and provides a support means for resting the device and essentially all of the weight of the barbell on the trapezius upper back muscles of weight lifters. The device has a laterally extending body that is operable to be placed across the back of a weight lifter, a bar securing means disposed on its top, and a centrally disposed and downwardly extending lobe on the back of the device. The lobe, along its inner surface, is operable to rest essentially the entire weight of the barbell on the trapezius upper back muscles of a weight lifter. The preferred embodiment of the invention includes a lobe having a convexly curved inner surface that is curved to generally mate with the trapezius upper back muscles in the valley between the left and right sides of the muscles.

7 Claims, 2 Drawing Sheets

LOAD DISTRIBUTION DEVICE FOR WEIGHT LIFTING

BACKGROUND OF THE INVENTION

1. A Field Of The Invention

This invention relates to a weight lifting device for supporting a barbell, and more particularly to a weight lifting device to distribute the load from the weight lighting bar to the trapezius muscles for performing squat and lung exercises in which the legs are used to alternately raise and lower the upper portion of the body while maintaining the spine in an erect position.

2. Description of Related Art

It is common practice during squat exercises for the subject to grip the barbell shaft on opposite sides of his head to maintain side-to-side balance while permitting the intermediate shaft portion to rest upon the shoulders and behind the neck. When loads of even moderate magnitude are concentrated upon the relatively small contact area between the shaft and shoulders, intense pain and discomfort can result as well as an injury to the neckbone.

Heretofore, numerous types of weight lifting devices have been suggested, but so far as applicant is aware, no exercising device has been constructed in accordance with the present invention or which purports to obviate the above-mentioned problems currently encountered in barbell squat exercises. Weight lifting aids such as those disclosed in U.S. Pat. Nos. 3,679,107, 4,213,605 and 4,722,524 rely heavily on transferring the weight from the bar to the shoulder deltoid muscles. The deltoid muscle group houses the very injury prone rotator cuff assembly and should not be involved in a major weight support role in the performance of the squat or lung exercises. Doing so presents a possibility for damage and/or injury.

U.S. Pat. No. 4,213,605 discloses a weightlifter's protective gear adapted to releasably support a barbell assembly behind the neck and adjacently above the shoulders during exercises. Specifically, the gear comprises a pair of cushion-lined shield straddling the neck and fitting snugly against the shoulders and the upper front and back body areas of the subject, in combination with an upwardly extending notched projection or projections on the shoulder portions of the shield for supporting the barbell shaft, whereby the entire weight of the assembly is uniformly distributed over the shoulders. Each of the shoulder sections **18, 18*a* is composed of a cushioned layer or interwebbing 23** adapted to fold over the shoulder of the wearer with the opposite ends thereof extending downwardly over the fore and aft upper body surfaces so as to snugly fit against the trapezius and deltoid muscular areas of the shoulder. However, such a device does not distribute the force of the weights so as to best protect the weight lifter while doing exercises such as squats. Furthermore, it is complicated to make, use, and fasten.

The prior art teaches to avoid a great deal, and for some prior art devices a preponderance, of force from being transmitted through the seventh cervical vertebrae and the first dorsal vertebrae, (when these exercises are performed in the traditional fashion) and directly down the vertebral column. But the prior art teaches to transmit the force through the deltoid muscles which houses the rotator cuff which is injury prone. The force should be distributed essentially through the trapezius muscle group, thereby introducing the load more gradually to the spinal column.

There is a long felt need as evidenced by the prior art to provide a weight lifting aid to distribute the load of the barbell so as to prevent damage to the weight lifters spine, rotator cuff and limit the amount of pain experienced by the weight lifter. The pain can divert the lifter's attention from the lift, the form and the technique. There is also a commercial need to accommodate the vast differences between the various human forms in the shoulder and provide a device which fits many differently shaped and sized people. Such a device should be able to be constructed so that "one size fits all".

SUMMARY OF THE INVENTION

A weight lifting device is provided which removably snaps to the bar of a barbell and provides a support means for resting the device and essentially all of the weight of the barbell on the trapezius upper back muscles of weight lifters. The present invention provides a device having a body extending laterally, to be placed across the back of a weight lifter, and having a bar securing means disposed on its top outer surface and a central downwardly extending lobe on the back of the device. The lobe, along its inner surface, is operable to rest essentially the entire weight of the barbell on the trapezius upper back muscles of a weight lifter.

The device of the present invention is preferably a one piece injection molded plastic device. The lobe is centrally located on the back of the device and has an inner surface convexly curved in the transverse direction. The convexly curved inner surface of the lobe is curved to generally mate with the trapezius upper back muscles and the valley between the left and right sides of the muscles.

A means to removably snap a weight lifting bar to the device is provided a pair of upwardly projecting bosses having coaxial cylindrically sectored channels formed in the device which is preferably made of a hard, somewhat resilient, plastic material. The resilient plastic material is one that provides sufficient resiliency to allow the bosses to be removably snapped and secured to the barbell bar. The preferred material is a polyurethane that has sufficient resiliency for the bosses to be removably snapped to the bar. Other suitable materials include polyethylene and a thermoplastic olefin.

An optional feature of the device is two front curved projections that are operable to straddle the user's neck and are substantially smaller than the back lobe. The projections help center and stabilize the device and are concavely curved inward from front to back. The projections are sufficiently curved so as not to engage the deltoid muscles during normal exercising. The projections only come into play when the weightlifter's footing is compromised and the bar bobs from side to side.

ADVANTAGES

A principal advantage of the present invention is that during squats with barbells it keeps the preponderance of force from being transmitted through the seventh cervical vertebrae and the first dorsal vertebrae directly down the vertebral column. Another advantage is that essentially the entire force is distributed through the trapezius back muscle group which introduces the load more gradually to the spinal column than with prior devices.

One advantage of the present invention is that it uses similarities in the human form by using the trapezius back muscles and avoids using areas where vast differences occur such as the deltoids or shoulders which makes it possible for the device to be made in one size. This makes it possible to keep tooling and manufacturing costs low. It also makes it possible for two or more people that exercise together to share one device.

Another advantage provided by the present invention is a comfort level previously unavailable allowing the lifter to focus on his exercise form and making it possible to take advantage of the human body's adaptive response ability and progress with continual gains in muscle mass and functional strength. The present device is also safer because the device of the present invention does not use the deltoid muscles, an injury prone area that varies tremendously from individual to individual in size and shape. A particular advantage of the present invention is protection of the rotator cuff during the exercise.

Another advantage is that the weight lifting device which once centered and snapped into position remains snugly affixed to the bar. This eliminates the common problem of not having any way of assuring the lifter, once the bar is positioned behind the head, that the weights on either end of the bar are truly equidistant form the lifter. A mal-alignment of as little as 0.5 inch, particularly when maximum weight is used, can totally change the feel of the exercise and shift the gravitational pull to one side greatly increasing the chance of failure and/or injury.

BRIEF DESCRIPTION OF THE DRAWINGS

The foregoing aspects and other features of the invention are explained in the following description, taken in connection with the accompanying drawings where.

DETAILED DESCRIPTION OF INVENTION

Figure 1:
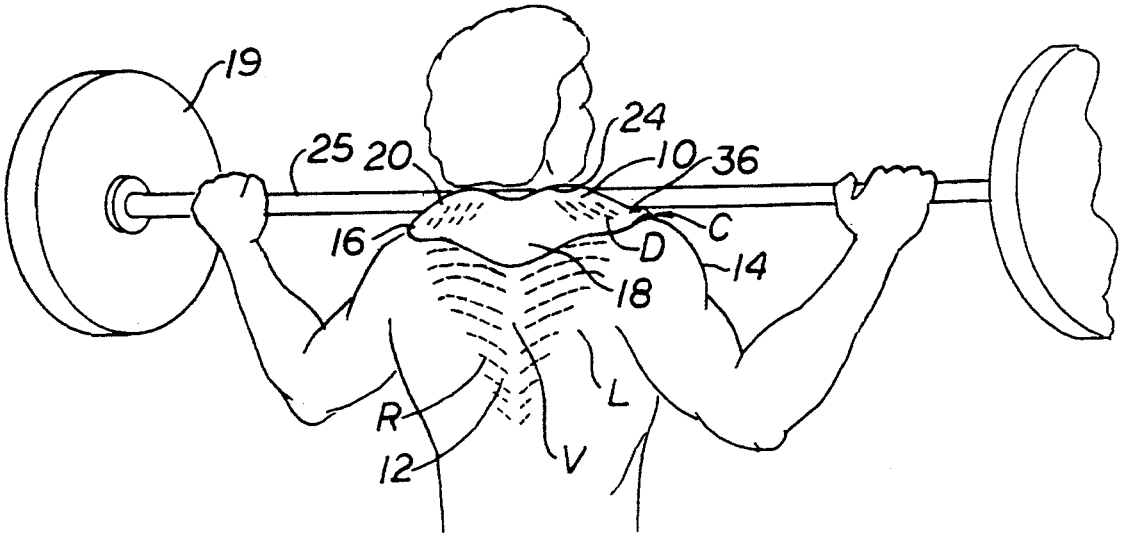
FIG. 1 is a perspective view of a weight lifting device in accordance with one embodiment of the present invention mounted on a weight lifter.

Illustrated in FIG. 1 is a weight lifting device 10 in accordance with one embodiment of the present invention. Device 10 is shown laterally disposed across the trapezius upper back muscles 12 of a weight lifter 14. For the purposes of this patent the following conventions are used. Front and back correspond to the front and back of a person such a weight lifter and a lateral direction is across the body from side to side. Inner or inward refers to facing the body of the weight lifter 14 and outer or outward refers to facing away from the body.

The device 10 is preferably a one-piece article that is rather elongated and symmetrical with respect to a central plane that bisects the device. The device 10 has a laterally extending body 16, operable for placement across the back of a weight lifter 14, and a centralized back lobe 18 located on the back of the device 10 and depending from a top portion 20 of the body 16. The central lobe 18 is oriented and operable to rest on the trapezius upper back muscles 12 of the weight lifter 14. The centrally spaced lobe 18 is designed to coincide with and a valley V formed by left L and right R trapezius upper back muscles 12. A bar securing means 24 is disposed on the top portion 20 to hold a bar 25 of the barbell 19.

Figure 2:
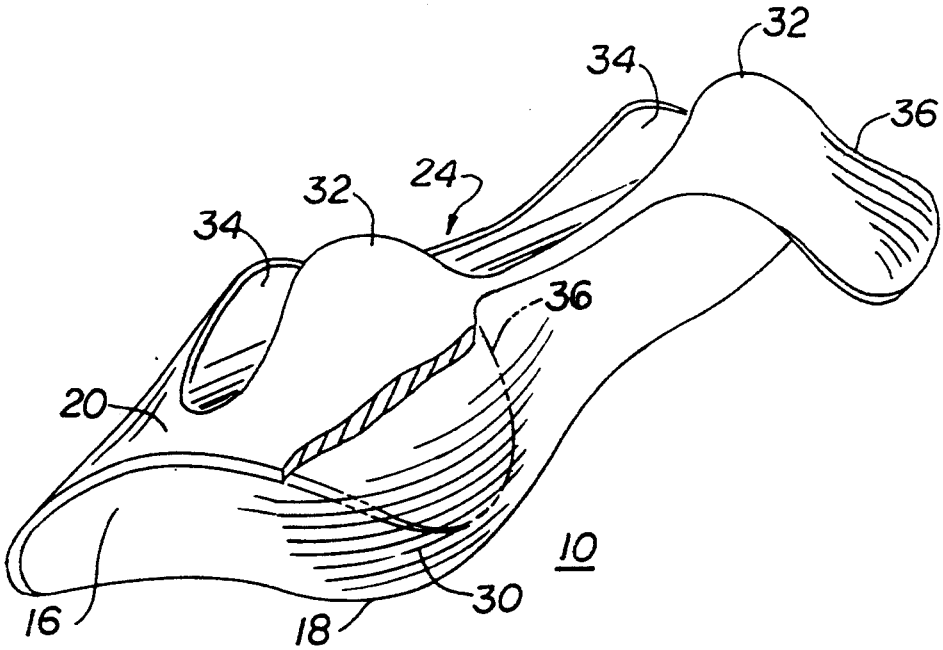
FIG. 2 is a partially cut-away perspective view from the top looking down of the weight lifting device depicted in FIG. 1.

A more detailed illustration of device 10 is shown in FIG. 2 which more distinctly points out several features of the preferred embodiment of the present invention. An inside view of the centralized back lobe 18 which depends from the top portion 20 of the body 16 shows that the lobe 18 preferably has an inwardly convex surface 30 so as to better fit in and conform to the contour of the valley V formed by the left L and right R trapezius upper back muscles 12 shown in FIG. 1. The shape and contour of the lobe 18 is operable to rest essentially the entire weight of a barbell 19 on the trapezius upper back muscles of a weight lifter shown in FIG. 1.

Still referring to FIG. 2, the bar securing means 24 disposed on the top portion 20 of device 10 has a pair of upwardly projecting bosses 32 that are provided with coaxial cylindrically sectored channels 34. In order to removably snap the weight lifting bar 25 to the device 10 the channels 34 have a diameter that is slightly less than the diameter of the bar 25 and the channels extend circumferentially slightly more than 180°. This allows device 10 to remain secured in place when it is snapped to the bar 25 and removably held by the channels 34.

An optional feature of the preferred embodiment are a pair of inwardly curved projections 36 depending downwardly and outwardly from the top portion 20 of the body 16. The projections 36 are spaced apart to straddle the weight lifter's neck and are substantially smaller than the back lobe 18. The projections 36 help center and stabilize the device 10 and are concavely curved inward from front to back as can better be seen from the view in FIG. 3. The projections 36 are sufficiently curved so as not to engage the deltoid muscles D in FIG. 1 during normal exercising as can bee seen by the clearance C between the projections 36 and the deltoid muscles D. By this design the device 10 is operable to rest essentially the entire weight of the barbell 19 on the trapezius upper back muscles 12 of the weight lifter 14.

Figure 3:
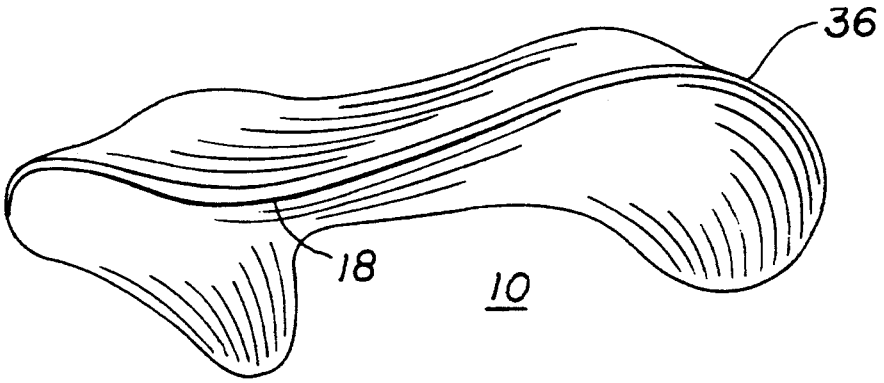
FIG. 3 is a perspective view from the bottom looking up of the weight lifting device depicted in FIG. 2.
Figure 4:
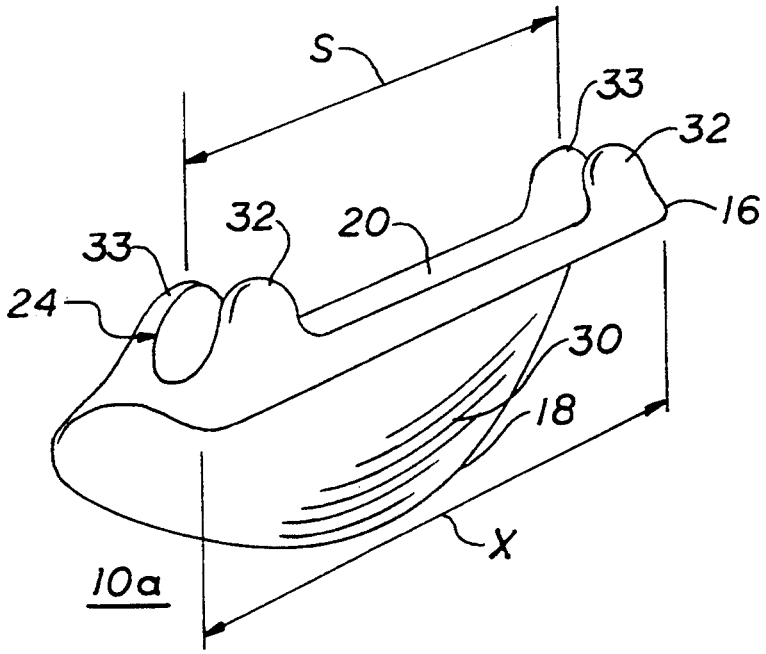
FIG. 4 is a perspective view of a weight lifting device in accordance with an alternate embodiment of the present invention.

Illustrated in FIG. 4 is a compact version of the present invention in the form of an alternative weight lifting device 10A having a laterally extending body 16, operable for placement across the back of a weight lifter 14 as shown in FIG. 1, and a centralized back lobe 18 located on the back of the device 10A and depending from a top portion 20 of the body 16. As in the embodiment in FIGS. 1–3, the central lobe 18 is oriented and operable to rest on the trapezius upper back muscles and spaced and formed to coincide with a valley V formed by left L and right R trapezius upper back muscles 12 shown in FIG. 1. A bar securing means 24 is disposed on the top portion 20 to hold a bar of a barbell- The lobe 18 preferably has an inwardly convex surface 30 so as to better fit in and conform to the contour of the valley V formed by the left L and right R trapezius upper back muscles 12 shown in FIG. 1.

The length X of the alternative device 10A is substantially shorter than the device 10 of the embodiment illustrated in FIG. 1. For example the device 10 may be 13 inches long while the alternative device 10A may be 7½ inches long. The bosses 32 may be spaced a distance S from center 33 to center 33 of about 5½ inches in the alternative device 10A and about 11 inches in the device 10 in FIGS. 1–3. Front projections 36 of the device 10 illustrated in FIGS. 1–3 are not used in the alternative device 10A of FIG. 4.

While the preferred embodiment of the present invention has been described fully in order to explain its principles, it is understood that various modifications or alterations may be made to the preferred embodiment without departing from the scope of the invention as set forth in the appended claims. The invention is, therefore, claimed in any of its forms or modifications within the proper scope of the appended claims appropriately interpreted in accordance with the doctrine of equivalents.

I claim:

1. A weight lifting device to help support a barbell used by a weight lifter by the barbell's bar, said device comprising:

a laterally extending one-piece body having a top portion and made of a hard material, a bar support means for supporting the bar, said bar support means attached to said body, a weight distribution means including a lobe centrally disposed and longitudinally extending downward from a back of said body, said lobe has an inwardly convex surface adapted to conform to the contour of the valley formed by the left and right trapezius upper back muscles of the user, and curved projections depending downwardly and outwardly from said top portion, said projections are adapted to straddle the user's neck and are sufficiently concavely curved inward from the front to back so as not to engage the deltoid muscles during exercising.

2. A device as claimed in claim 1, wherein said bar support means includes a snap fit means to removably attached said body to the bar.

3. A device as claimed in claim 2 wherein said snap fit means comprises oppositely disposed bosses upwardly projecting from said top portion and having coaxial cylindrically sectored channels operable to hold a bar and a channel diameter that is slightly less than a diameter of said bar and said channels extend circumferentially at least slightly more than 180°.

4. A device as claimed in claim 1 wherein said bar support means includes a snap fit means to removably attach said body to the bar.

5. A device as claimed in claim 4 wherein said snap fit means comprises oppositely disposed bosses upwardly projecting from said top portion and having coaxial cylindrically sectored channels operable to hold a bar and a channel diameter that is slightly less than a diameter of said bar and said channels extend circumferentially at least slightly more than 180°.

6. A device as claimed in claim 5 wherein said device is made of a resilient plastic material that provides sufficient resiliency to allow said bosses to be removably snapped and secured to the bar.

7. A device as claimed in claim 6 wherein said resilient plastic material is a polyurethane.

* * * * *